US005561292A

United States Patent [19]

Buckley et al.

[11] Patent Number: 5,561,292

[45] Date of Patent: Oct. 1, 1996

[54] MASS SPECTROMETER AND ELECTRON IMPACT ION SOURCE THEREOF

[75] Inventors: Mark E. Buckley, Crewe; Ian Koch, Northwich; Andrew Stevenson, Sandbach, all of England

[73] Assignee: Fisons plc, Ipswich, England

[21] Appl. No.: 441,248

[22] Filed: May 15, 1995

[30] Foreign Application Priority Data

May 17, 1994 [GB] United Kingdom ..... 9409953

[51] Int. Cl.[6] ..... H01J 27/20

[52] U.S. Cl. ..... 250/288; 250/427

[58] Field of Search ..... 250/288, 288 A, 250/281, 282, 423 R, 424, 427, 423 F

[56] References Cited

U.S. PATENT DOCUMENTS

| | | | |
|---|---|---|---|
| 3,930,163 | 12/1975 | Gerlach et al. | 250/427 |
| 4,039,828 | 8/1977 | Bokar et al. | 250/288 |
| 4,272,699 | 6/1981 | Faubel et al. | 250/427 |
| 4,481,062 | 11/1984 | Kaufman et al. | 250/423 R |
| 4,620,102 | 10/1986 | Watanabe et al. | 250/288 |
| 4,755,669 | 7/1988 | Grant et al. | 250/288 |
| 5,153,432 | 10/1992 | Devant et al. | 250/427 |

FOREIGN PATENT DOCUMENTS

| | | |
|---|---|---|
| 0311224B1 | 3/1984 | European Pat. Off. . |
| 1237028 | 4/1969 | United Kingdom . |
| 1507087 | 12/1975 | United Kingdom . |

OTHER PUBLICATIONS

Pulsed, gridded electron reversal ionizer, Rev. Sci. Instrum., May 1993, 1993 American Institute of Physics, pp. 1135–1139, Bonmsellek et al.

Mass Spectrometer Ion Source for Ionization Cross–Section Measurement, The Journal of Vacuum Science and Technology, vol. 5, No. 5, May 1968, pp. 131–140, Crawford.

Modified Ion–source Cage for a Clinical Mass Spectrometer, P. Beatty, W. Greer, B. Kay, Mideical & Biological Engineering & Computing, Nov. 1981, pp. 770–774.

Enrichmant of Rare Gas Isoltopes Using a Quadupole Mass Spectrometer, C. H. Chen, R. D. Willis, G. S. Hurst, Oak Ridge Nation Laboratory, TN, 1984 pp. 581–584.

*Primary Examiner*—Jack I. Berman
*Assistant Examiner*—Kiet T. Nguyen
*Attorney, Agent, or Firm*—Chilton, Alix & Van Kirk

[57] ABSTRACT

An enclosed ion source for generating substantially monoenergetic ions from a gaseous sample comprises a chamber into which the gaseous sample is introduced and which is substantially enclosed by a source block having two electron entrance apertures formed in it and by a source plate having one ion extraction aperture formed in it. Two filaments are disposed outside the chamber and adjacent the electron entrance apertures. The electron impact ion source is characterized by the provision of an electrically conductive shield which is disposed within the chamber and which defines an equipotential region. The electrons, generated from a heated filament, pass into the chamber through one of the electron entrance apertures. The shield allows the passage of molecules of the gaseous sample and the electrons into the equipotential region, so that electron impact ionization of at least some of the sample occurs in the equipotential region. The electron impact source may be incorporated into a conventional mass spectrometer.

23 Claims, 4 Drawing Sheets

MASS SPECTROMETER AND ELECTRON IMPACT ION SOURCE THEREOF

The present invention relates to a mass spectrometer having an electron impact ion source and more specifically to a mass spectrometer with an electron impact ion source having improved resistance to contamination.

BACKGROUND OF THE INVENTION

Electron impact ion sources for mass spectrometers; typically comprise an ionisation region into which a gaseous sample is introduced, means for introducing electrons into the ionisation region so that the electrons ionise the sample, and means for extracting ions from the ionisation region. There are two types of electron impact ion source, the enclosed ion source and the open ion source. The open ion source is commonly used for applications involving gaseous samples contained in volumes substantially greater than that of the open ion source, for example as shown in Beatty, Greer and Kay in Med. & Biol. Eng. & Computing, 1981, Vol 19, p770–774. The ionisation region of a typical prior open ion source is surrounded by a pumped enclosure into which the sample is introduced. The ionisation region is defined by a cage through which electrons and molecules of the gaseous sample are able to pass. A filament:, which is maintained at a negative potential relative to the cage, is mounted outside the ionisation region and the potential difference between the cage and the filament is typically 20–70 V. An electric current is driven through the filament, to heat it, by a filament power supply. Electrons, which are generated by thermionic emission from the filament, are accelerated by the potential difference between the cage and the filament. The electrons pass into the ionisation region and collide with the sample to generate ions from. the sample. Power control means are typically provided to monitor the electron current at the cage and control the filament current, thereby maintaining the electron current at a preselected value. The ions may be extracted by a weak electric field which penetrates through an extraction aperture formed in the cage. The electric field is generated by the application of a potential difference to electrodes mounted outside the ionisation region and adjacent to the extraction aperture. For an open ion source incorporated into a mass spectrometer, ions are extracted from the source before being transferred to a mass analyser.

The gaseous sample is able to pass freely through the cage of the open ion source. The pressure in the region surrounding the filament is thus equal to the pressure within the ionisation region and the filament is exposed to the sample under analysis. The sample may be highly corrosive and this may result in degradation and ultimate failure of the filament. The possibility of filament failure is taken into account in many open ion sources by the provision of an auxiliary filament mounted adjacent to the cage. The auxiliary filament is not used to generate electrons unless the other filament burns out. The exposure of the filaments to the sample limits the pressure at which open ion sources may operate to the range $10^{-4}$ to $10^{-12}$ torr.

The second type of electron impact ion source is the enclosed ion source, an example of which is described in European patent specification 311224. The ionisation region of such an enclosed ion source is substantially enclosed by a wall to form a chamber. The wall is comprised of a solid electrically conducting material. A heated filament is mounted outside the ionisation region as described above. A gaseous sample which is introduced into the chamber is excluded from the region surrounding the heated filament by the wall. Typically the potential difference between the wall and the heated filament is in the range 20–70 V so that electrons are accelerated into the chamber through an electron entrance aperture formed in the wall. The electrons interact with the sample to generate ions from the sample. A second aperture may be formed in the wall so that the electrons can pass from the chamber to an electron trap. Power control means are typically provided to monitor the electron current at the trap and control the filament current, thereby maintaining the electron current at a preselected value. The ions are extracted through an ion extraction aperture formed in the wall, in the same way as described for the open ion source. The wall defines a substantially equipotential region, resulting in the formation of substantially monoenergetic ions.

Since the ionisation region is substantially enclosed, the pressure within the ionisation region may be much higher than for an open ion source (typically 0.5 to 1 mtorr) while the pressure in the region of the heated filament can be maintained at a much lower value, for example 10 torr or less. The heated filament is also separated from the sample, avoiding contamination and corrosion off the filament and increasing its lifetime. Enclosed ion sources are more suitable than open ion sources for analysis of a limited quantity of gaseous sample.

The operation of an enclosed electron impact ion source may be affected by the undesirable effect of impurities, such as organic materials or oxides, which can build up on the inner surface of the chamber. This may be due to the exposure of the chamber to gaseous samples under analysis or from diffusion of contaminants within the material of the wall. Such impurities may form an insulating film which can become electrically charged, seriously reducing the source performance, for example by causing potential gradients in the ionisation region which increases the energy spread of the ions. Further, this effect is mass dependent. The problems associated with contamination of electron impact ion sources are discussed in U.S. Pat. No. 4,481,062 and a number of solutions to this problem have been suggested. For example, the construction of a source to facilitate cleaning is outlined in U.S. Pat. No. 4,481,062. C. Chen et al, in Vacuum, 1984, Vol 34, No. 5, p 581–584, suggest that baking a source at 250° C. for 48 hours is beneficial in reducing outgassing, and that electropolishing certain source components reduces the adsorption on the surface of those components.

SUMMARY OF THE INVENTION

It is one of the objectives of the present invention to provide a mass spectrometer comprising an enclosed ion source which has greater resistance to contamination than prior types of mass spectrometer. It is a further objective of the invention to provide an enclosed ion source which has an improved resistance to contamination than prior types of enclosed ion source.

In accordance with these objectives, there is provided a mass spectrometer comprising an enclosed ion source, ion mass analysing means, and ion detection means disposed to receive ions transmitted by said mass analysing means, said enclosed ion source comprising:

(a) a chamber which is substantially enclosed by a wall, said wall having at least one electron entrance aperture and at least one ion extraction aperture;

(b) means for introducing a gaseous sample into said chamber;

(c) one or more means for generating electrons, disposed outside of said chamber, such that said electrons may pass through one or more of said electron entrance apertures into said chamber;

said mass spectrometer characterised by the provision of electrically conductive shield means disposed within said chamber, said shield means defining a substantially equipotential region, while being substantially transparent to said electrons and molecules of said gaseous sample, so that said electrons may ionise said molecules within said equipotential region to generate ions therefrom, and whereby said ions may pass from inside said equipotential region through at least one of said ion extraction apertures to said mass analysing means.

Viewed from another aspect the invention provides an enclosed ion source for a mass spectrometer comprising:

(a) a chamber which is substantially enclosed by a wall, said wall having at least one electron entrance aperture and at least one ion extraction aperture;

(b) means for introducing a gaseous sample into said chamber;

(c) one or more means for generating electrons, said means being disposed outside of said chamber, such that said electrons may pass through one or more of said electron entrance apertures into said chamber;

said enclosed ion source characterised by the provision of electrically conductive shield means disposed within said chamber, said shield means defining a substantially equipotential region, while being substantially transparent to said electrons and molecules of said gaseous sample, so that said electrons may ionise said molecules within said equipotential region to generate ions therefrom, and whereby said ions may pass from inside said equipotential region through at least one of said ion extraction apertures.

Typically the shield means should comprise an electrically conductive cage, for example a cage formed from a noble metal mesh. Preferably the mesh has a transparency greater than 20%, more preferably between 50% and 95% and still more preferably between 65% and 75%. In a preferred embodiment the shield means comprises both an electrically conductive cage and a portion of the wall in which at least one ion extraction aperture is formed, such that the ion extraction aperture leads into the substantially equipotential region.

Conveniently the wall is comprised largely of an electrically conductive material such as molybdenum or stainless steel, and typically will further comprise one or more portions of an insulating material. Preferably, the wall comprises an electrically conductive source block in which at least one electron entrance aperture is formed and an electrically conductive source plate to which the shield means is electrically connected. In one embodiment the source block is electrically connected to the source plate. In a more preferred embodiment the source plate is electrically isolated from the source block and the electron current at the shield means is monitored by a power control means which controls the means for generating electrons, such that the electron current is substantially maintained at a preselected value. Preferably said means for generating electrons comprises at least one filament, and more preferably said filament is formed from thoriated iridium or tungsten.

The inventors have found that a enclosed ion source according to the invention has a greater resistance to contamination than prior types of enclosed ion source.

Viewed from another aspect the invention provides a method for mass; spectral analysis of a gaseous sample comprising the steps of:

(a) introducing said gaseous sample into an enclosed ion source, said enclosed ion source comprising a chamber bounded by a wall in which is formed at least one electron entrance aperture and at least one ion extraction aperture;

(b) generating electrons and admitting them to said chamber through one or more of said electron entrance apertures whereby said electrons may ionise at least some of said gaseous sample introduced in step (a);

(c) mass analysing at least some of the ions produced in step (b) which leave said chamber through at least one of said ion extraction apertures; and (d) detecting at least some of the ions mass analysed in step (c);

said method characterised by the further steps of:

(i) providing electrically conductive shield means to define within said chamber a substantially equipotential region, said shield means allowing the free passage of electrons and molecules, so that electron impact ionisation of at least some of said gaseous sample may take place within said substantially equipotential region; and (ii) extracting ions formed within said substantially equipotential region and passing them through at least one of said ion extraction apertures.

The invention further provides a method of ionising a gaseous sample comprising the steps of:

(a) introducing said gaseous sample into an enclosed ion source, said enclosed ion source comprising a chamber bounded by a wall in which is formed at least one electron entrance aperture and at least one ion extraction aperture;

(b) generating electrons and admitting them to said chamber through one or more of said electron entrance apertures whereby said electrons ionise at least some of said gaseous sample introduced in step (a)

said method characterised by the further steps of:

(i) providing electrically conductive shield means to define within said chamber a substantially equipotential region, said shield means allowing the free passage of electrons and molecules, so that electron impact ionisation of at least some of said gaseous sample may take place within said substantially equipotential region; and (ii) extracting ions formed within said substantially equipotential region and passing them through at least one of said ion extraction apertures.

A preferred embodiment of the invention will now be discussed by way of example only and with reference to the figures in which:

DESCRIPTION OF THE PREFERRED EMBODIMENTS

Figure 1:
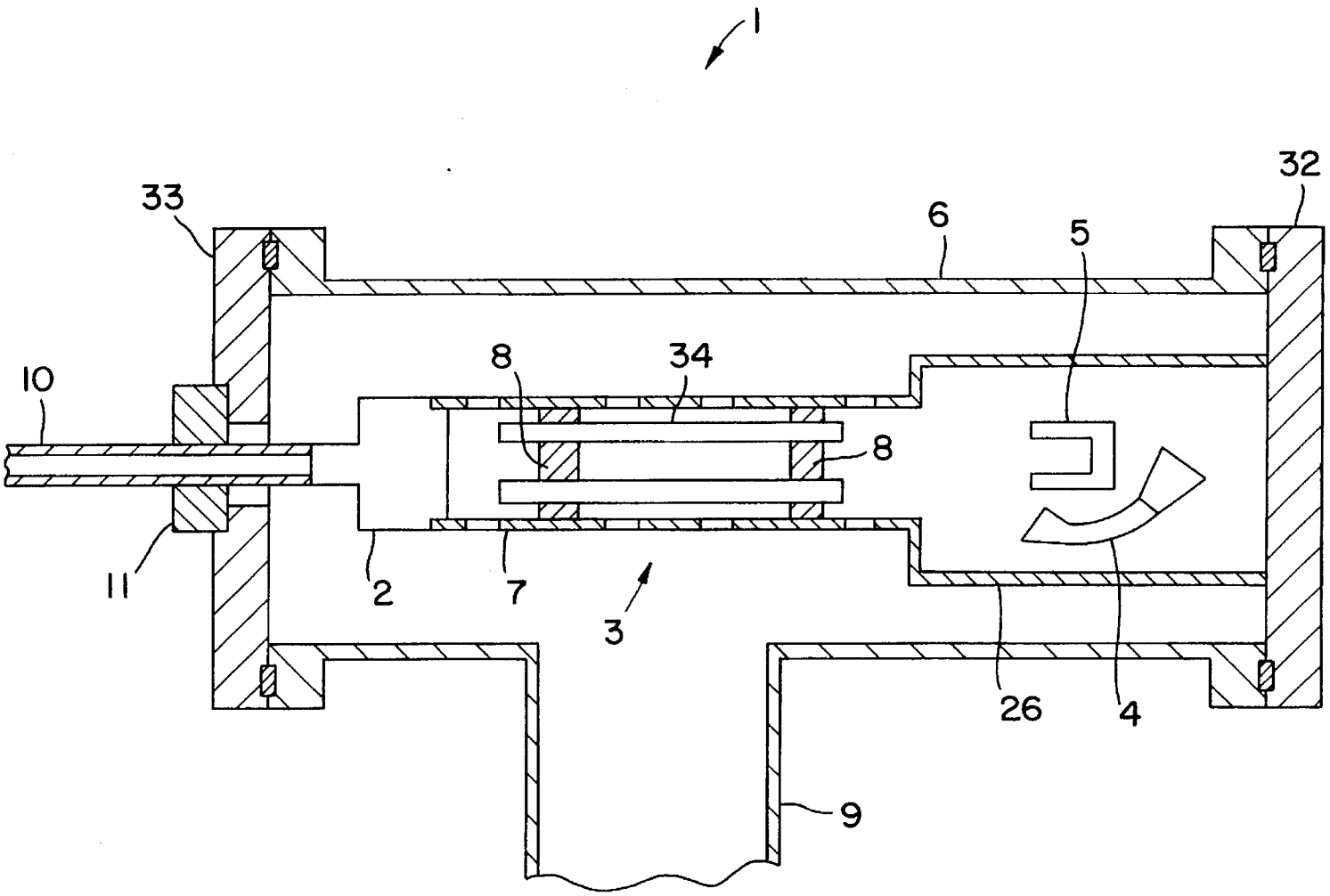
FIG. 1 is a schematic diagram of a mass spectrometer incorporating an enclosed ion source according to the invention.

Referring first to FIG. 1, a mass spectrometer generally indicated by 1 comprises an enclosed ion source 2 (shown in FIG. 2), ion mass analysing means; comprising a quadrupole mass filter 3, ion detection means comprising an off-axis electron multiplier 4 and a Faraday collector 5, all disposed in a vacuum housing 6. The quadrupole mass filter 3 comprises four rods 34 having circular cross section, a mass filter housing 7 and insulating supports 8 which electrically isolate the four rods from each other and from the mass filter housing 7. The vacuum housing 6 is evacuated through a port 9 by a turbomolecular vacuum pump (not shown). A sample inlet tube 10, which passes through and is welded to a flange 11, is inserted into the enclosed ion source 2. A gaseous sample to be analysed may be introduced, through the sample inlet tube 10, into the enclosed ion source 2. The flange 11 is sealed to the end flange 33 which is bolted to the vacuum housing 6. The enclosed ion source 2 is mounted from the mass filter housing 7 which is in turn mounted on detector housing 26. The detector housing 26 is mounted from a second end flange 32 which is bolted to the vacuum housing 6. Ions, which are formed by electron impact ionisation as a result of collisions between electrons and molecules of the gaseous sample in the enclosed ion source 2, pass from the enclosed ion source 2 into the quadrupole mass filter 3. Mass filtered ions which emerge from the quadrupole mass filter 3 are detected by an off-axis electron multiplier 4 or a Faraday collector 5.

Figure 2:
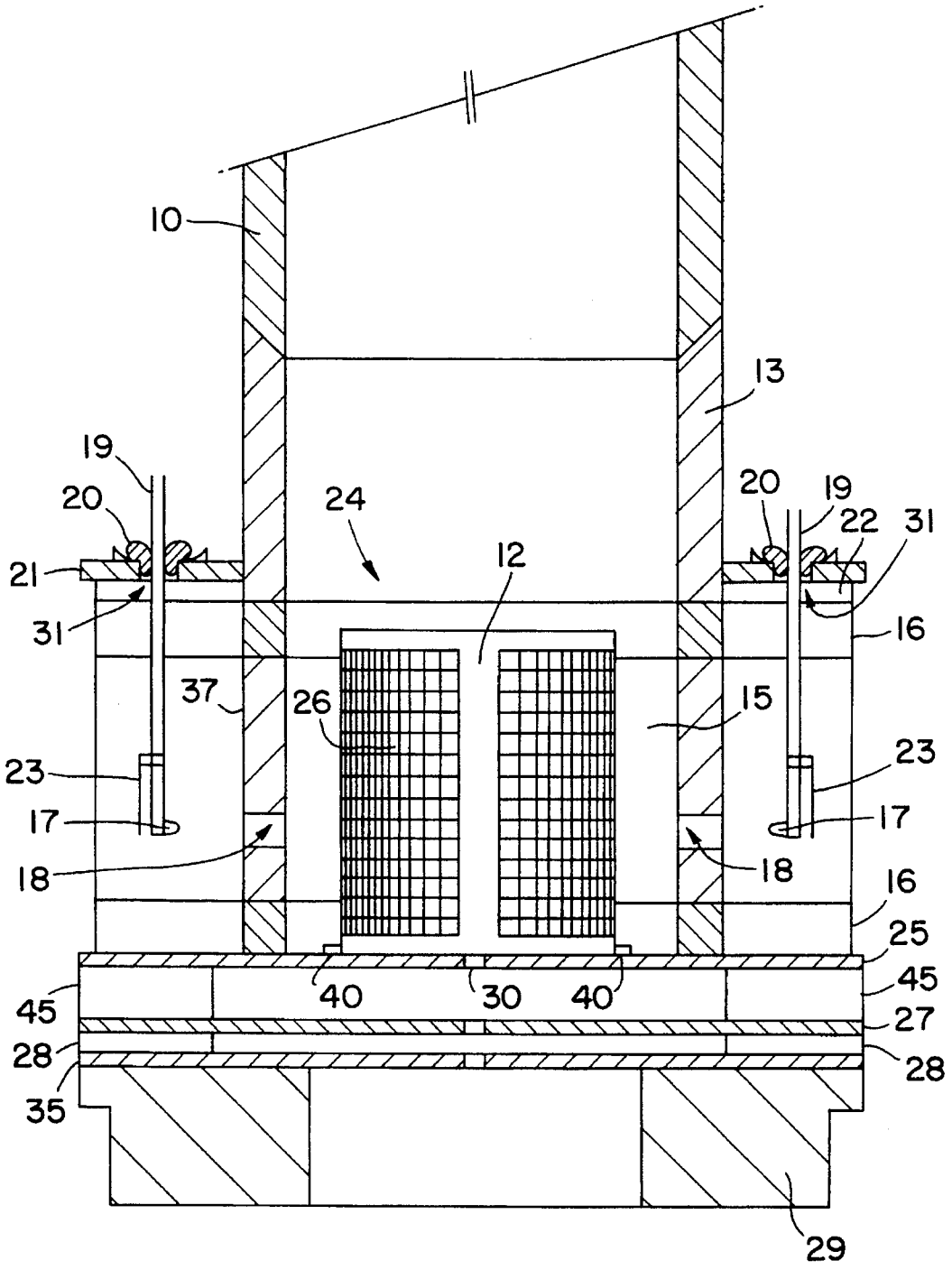
FIG. 2 is a sectional view of the enclosed ion source which may be incorporated into the mass spectrometer shown in FIG. 1.

FIG. 2 illustrates the construction of the enclosed ion source 2 suitable for use with the mass spectrometer 1. The gaseous sample to be analysed passes through an inlet adaptor 13, into which the sample inlet tube 10 is inserted, before entering a chamber 15. The chamber 15 is substantially enclosed by a wall comprising a source block 37, two insulating ceramic plates 16 and a source plate 25. Means for generating electrons comprise a pair of filaments 17 mounted adjacent to two electron entrance apertures 18 formed in the source block 37. Each end of each filament 17 is connected to one of four electrically conducting wires 19 which is passed through one of four holes 31 formed in a metal yoke 21. The metal yoke 21 fits over an adaptor flange 22 which is part of the inlet adaptor The electrically conducting wires 19 are bonded to and electrically isolated from the metal yoke 21 by silica glass 20. The source block 37 is electrically isolated from the inlet adaptor 13 and source plate 25 by two insulating ceramic plates 16. An electric current is passed through the one of the filaments 17 to heat it and generate electrons by thermionic emission. Typically, the filaments 17 are constructed from nine coils of a conducting metal such as tungsten or thoriated iridium. Two electron reflectors 23 are mounted behind the filaments 17 so that electrons are reflected towards the electron entrance aperture 18 which is adjacent to the filament 17 which is being heated. Because the chamber 15 is substantially enclosed the pressure in it, typically 5 mtorr, can be much higher than the pressure in the region of the filaments 17, typically $2.10^{-6}$ torr.

Figure 3:
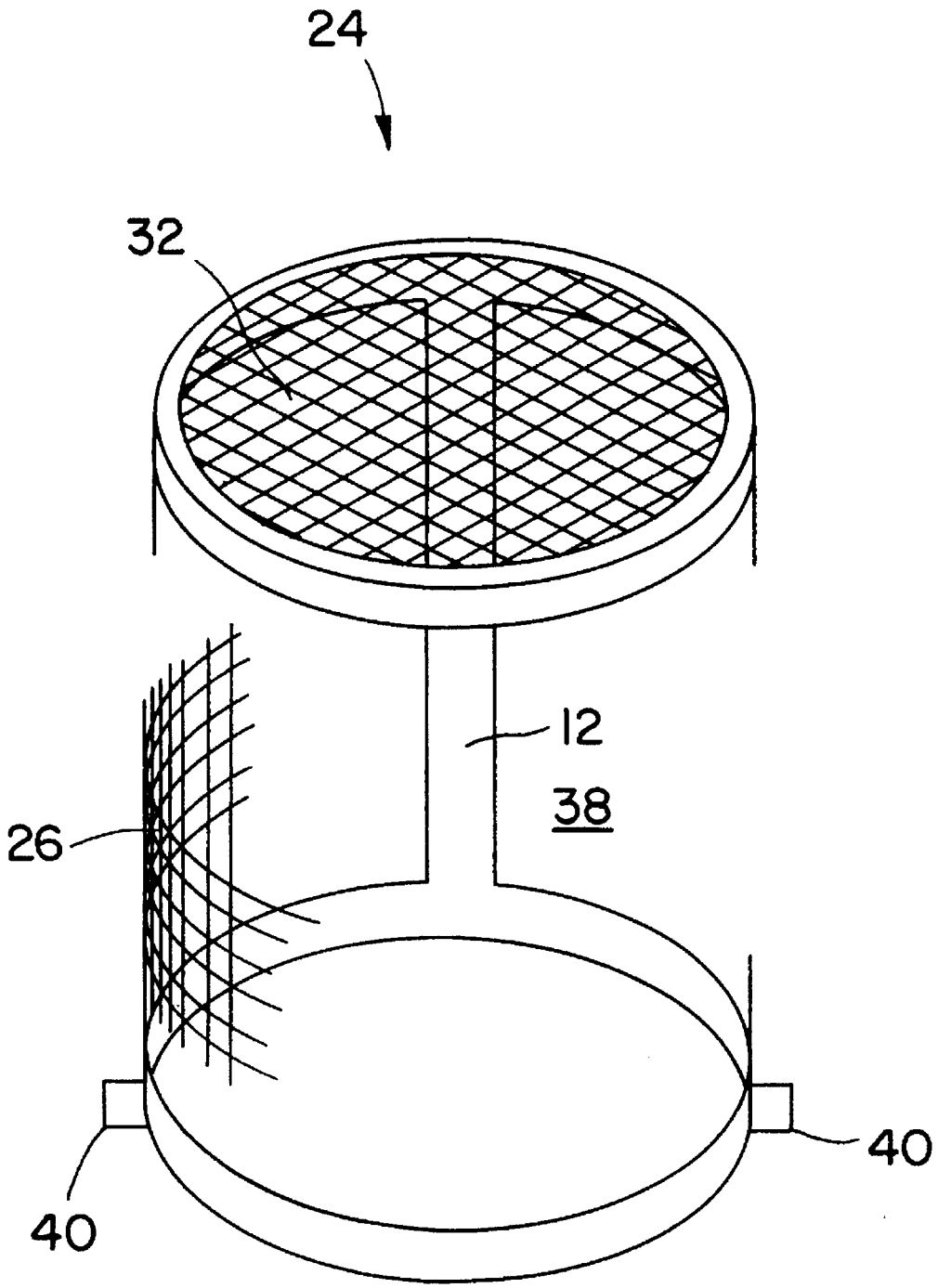
FIG. 3 is a perspective view of a frame which may be incorporated into the enclosed ion source shown in FIG. 2.

Referring to FIG. 3, electrically conducting shield means generally indicated by 24 comprises a cage formed by a cylindrical mesh 26, a circular mesh disc 32, and a frame 12. Two tags 40 are formed from part of the frame 12 at one end of the cylindrical mesh 26 and the end of the cylindrical mesh 26 which is opposite the tags 40 is closed by the circular mesh disc 32. The electrically conducting shield means 24 is disposed within the chamber 15 (as shown in FIG. 2) and is electrically connected to the source plate 25 by the two tags 40, which are welded to the source plate 25. Both the cylindrical mesh 26 and the circular mesh disc 32 are constructed from a conducting wire mesh, typically a platinum wire mesh having a transparency of 70%. The tags 40 and frame 12 are constructed from stainless steel, the source block 37 is constructed from molybdenum.

Figure 4:
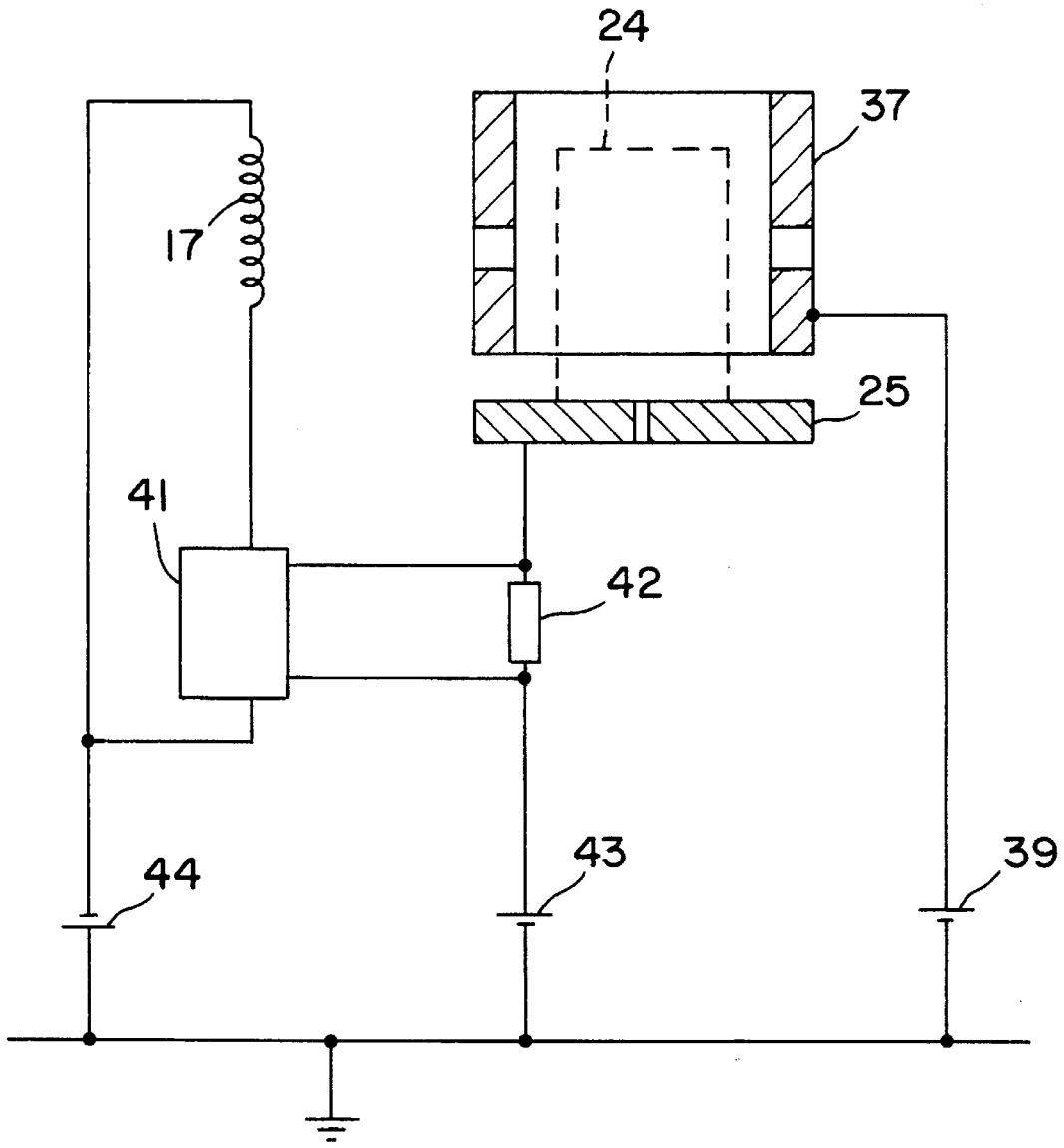
FIG. 4 is a schematic diagram of an electrical circuit suitable for use with the ion source of FIG. 2.

FIG. 4 illustrates a circuit for the control of electron current and electron energy at the shield means 24. The electron current at the shield means 24 results in a potential difference, $V_R$ across a resistor 42 which is monitored by a power control means 41. The current through the filament 17 is controlled by the power control means 41, in response to changes in $V_R$, so that the electron current at the shield means 24 is maintained at a preselected value. The shield means 24 is electrically connected to the source plate 25. The potential of the source block 37 relative to ground is typically maintained at +5 volts by a power supply represented by the battery 39, that of the filaments 17 between −10 volts and −70 volts a power supply represented by the battery 44 and that of the shield means 24 between +5 and +15 volts by a power supply represented by a battery 43.

An equipotential region 38 (shown in FIG. 3) is defined by the shield means 24 which allows the free passage of electrons and molecules, so that electrons entering the equipotential region 38 interact with the sample to generate ions from the sample. A drawing out plate 27 is spaced from the source plate 25 by an electrically insulating ceramic plate 45. A focusing plate 35 is spaced from the drawing out plate 27 by four insulating ceramic washers 28. An extraction electric field is generated by the application of a potential difference between the drawing out plate 27 and the focusing plate 35. The ions are extracted from the equipotential region 38 through an ion extraction aperture 30 before entering the quadrupole mass analyser 3, as shown in FIG. 1. The inlet adaptor 13, metal yoke 21, insulating ceramic plates 16, source block 37, source plate 25, ceramic plate 45, drawing out plate 27, focusing plate 35 and insulating ceramic washers 28 are all bolted to a base plate 29 by four bolts (not shown). The base plate 29 is inserted into the mass filter housing 7 and is secured to the housing 7 by four threaded pins (not shown) which pass through the housing 7 and into the base plate 29.

The presence of the shield means 24 shields the sample ions from any charge that may develop on the inner surface of the source block 37 and thereby maintains the efficient performance of the enclosed ion source 2 for longer periods than would be possible with a prior type of enclosed ion source.

We claim:

1. An enclosed ion source for a mass spectrometer comprising:

(a) a chamber which is substantially enclosed by a wall, said wall having at least one electron entrance aperture and at least one ion extraction aperture;

(b) means for introducing a gaseous sample into said chamber; and (c) means for generating electrons, said means for generating electrons being disposed outside of said chamber, such that said electrons pass through said at least one electron entrance aperture into said chamber;

wherein said enclosed ion source characterized by the provision of electrically conductive shield means disposed within said chamber, said shield means defining a substantially equipotential region, while being substantially transparent to said electrons and molecules of said gaseous sample, so that said electrons ionise said molecules within said equipotential region to generate ions therefrom, and whereby said ions pass from inside said equipotential region through said at least one ion extraction aperture.

2. An enclosed ion source as claimed in claim 1 wherein said shield means comprises an electrically conductive cage.

3. An enclosed ion source as claimed in claim 2 wherein said shield means further comprises a portion of said wall in which said at least one ion extraction aperture is formed, such that said ion extraction aperture leads into said substantially equipotential region.

4. An enclosed ion source as claimed in claim 2 wherein said cage comprises a noble metal mesh.

5. An enclosed ion source as claimed in claim 4 wherein said mesh has a transparency greater than 20%.

6. An enclosed ion source as claimed in claim 4 wherein said mesh has a transparency between 50% and 95%.

7. An enclosed ion source as claimed in claim 4 wherein said mesh has a transparency between 65% and 75%.

8. An enclosed ion source as claimed in claim 1 wherein at least part of said wall comprises molybdenum.

9. An enclosed ion source as claimed in claim 1 wherein said wall comprises an electrically conductive source block in which said at least one electron entrance aperture is formed and an electrically conductive source plate to which said shield means is electrically connected.

10. An enclosed ion source as claimed in claim 9 wherein said source block is electrically connected to said source plate.

11. An enclosed ion source as claimed in claim 9 wherein said source block is electrically isolated from said source plate.

12. An enclosed ion source according to claim 11 wherein current at said shield means due to said means for generating electrons is monitored by a power control means which controls the means for generating electrons, such that said current is substantially maintained at a preselected value.

13. An enclosed ion source as claimed in claim 1 wherein said means for generating electrons comprises at least one filament, said filament comprising thoriated iridium.

14. An enclosed ion source as claimed in claim 1 wherein said means for generating electrons comprises at least one filament, said filament comprising tungsten.

15. A mass spectrometer comprising an enclosed ion source, ion mass analysing means, and ion detection means disposed to receive ions transmitted by said mass analysing means, said enclosed ion source comprising:

(a) a chamber which is substantially enclosed by a wall, said wall having at least one electron entrance aperture and at least one ion extraction aperture;

(b) means for introducing a gaseous sample into said chamber; and (c) means for generating electrons, said means for generating electrons being disposed outside of said chamber, such that said electrons pass through said at least one electron entrance aperture into said chamber;

wherein said mass spectrometer characterized by the provision of electrically conductive shield means disposed within said chamber, said shield means defining a substantially equipotential region, while being substantially transparent to said electrons and molecules of said gaseous sample, so that said electrons ionise said molecules within said equipotential region to generate ions therefrom, and whereby said ions pass from inside said equipotential region through said at least one ion extraction aperture to said mass analysing means.

16. A mass spectrometer as claimed in claim 15 wherein said shield means comprises an electrically conductive cage.

17. A mass spectrometer as claimed in claim 16 wherein said shield means further comprises a portion of said wall in which said at least one ion extraction aperture is formed, such that said ion extraction aperture leads into said substantially equipotential region.

18. A mass spectrometer as claimed in claim 15 wherein said wall comprises an electrically conductive source block in which said at least one electron entrance aperture is formed and an electrically conductive source plate to which said shield means is electrically connected.

19. A mass spectrometer as claimed in claim 18 wherein said source block is electrically connected to said source plate.

20. A mass spectrometer as claimed in claim 18 wherein said source block is electrically isolated from said source plate.

21. A mass spectrometer as claimed in claim 20 wherein current at said shield means due to said means for generating electrons is monitored by a power control means which controls the means for generating electrons, such that said current is substantially maintained at a preselected value.

22. A method of ionising a gaseous sample comprising the steps of:

(a) introducing said gaseous sample into an enclosed ion source, said enclosed ion source comprising a chamber bounded by a wall in which is formed at last one electron entrance aperture and at least one ion extraction aperture; and (b) generating electrons and admitting said electrons to said chamber through said at least one electron entrance aperture whereby said electrons ionise said gaseous sample introduced in step (a)

said method characterized by the further steps of:

(i) providing electrically conductive shield means to define within said chamber a substantially equipotential region, said shield means allowing the free passage of said electrons and molecules of said gaseous sample, so that electron impact ionisation of said gaseous sample take place within said substantially equipotential region; and (ii) extracting ions formed within said substantially equipotential region and passing said ions through said at least one of ion extraction aperture.

23. A method for mass spectral analysis of a gaseous sample comprising the steps of:

(a) introducing said gaseous sample into an enclosed ion source, said enclosed ion source comprising a chamber bounded by a wall in which is formed at least one electron entrance aperture and at least one ion extraction aperture;

(b) generating electrons and admitting said electrons to said chamber through said at least one electron entrance aperture whereby said electrons ionise said gaseous sample introduced in step (a);

(c) analysing at least some of the ions produced in step (b) which leave said chamber through said at least one of ion extraction aperture; and (d) detecting at least some of the ions analysed in step (c); said method characterised by the further steps of:

(i) providing electrically conductive shield means to define within said chamber a substantially equipotential region, said shield means allowing the free passage of said electrons and molecules of which gaseous sample, so that electron impact ionisation of said gaseous sample take place within said substantially equipotential region; and (ii) extracting ions formed within said substantially equipotential region and passing said ions through said at least one of extraction aperture.

* * * * *